US007886888B1

(12) United States Patent
Chien et al.

(10) Patent No.: US 7,886,888 B1
(45) Date of Patent: Feb. 15, 2011

(54) BILL BOX, BILL ACCEPTOR ASSEMBLY WITH BILL BOX

(75) Inventors: Tien-Yuan Chien, Taipei (TW); Sheng-Yan Tsao, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 12/656,957

(22) Filed: Feb. 22, 2010

(51) Int. Cl.
*G07F 7/04* (2006.01)

(52) U.S. Cl. ..... 194/206; 194/207; 209/534; 271/180; 271/181

(58) Field of Classification Search ..... 271/180, 271/181; 194/206, 207; 209/534
See application file for complete search history.

(56) References Cited

U.S. PATENT DOCUMENTS

2003/0214095 A1* 11/2003 Allen et al. ..... 271/177

* cited by examiner

*Primary Examiner*—Jeffrey A Shapiro
(74) *Attorney, Agent, or Firm*—Bacon & Thomas, PLLC

(57) ABSTRACT

A bill acceptor and bill box assembly includes a bill acceptor for sensing the presence of a bill and verifying the authenticity of the bill, and a bill box having a bill entrance for receiving bills from the bill acceptor, a bill-receiving bearing board supported on a spring member, a bill-pressing board movable by a bill transfer mechanism to push each entered bill out of the bill entrance onto the bill-receiving bearing board, and an anti-skid device, which comprises two baffles arranged in parallel at two opposite lateral sides between the bill-pressing board and the bill-receiving bearing board and an anti-skid pad covered on the back wall of each baffle for stopping each received bill on the bill-receiving bearing board to keep each received bill in a fully extended smooth condition without wrinkles.

26 Claims, 11 Drawing Sheets

BILL BOX, BILL ACCEPTOR ASSEMBLY WITH BILL BOX

BACKGROUND OF THE INVENTION

1. Field of the Invention

The present invention relates to bill acceptors and more particularly, to a bill box for bill acceptor, which has an anti-skid device for holding each received bill on a bill-receiving bearing board positively in a fully extended smooth condition without wrinkles.

2. Description of the Related Art

Following fast development of technology, our mode of living has been changed, and non-shop business has become popular. In consideration of convenience and rapidness, various automatic vending machines (card dispensers, ticket vending machines, coin exchanging machines, etc.), auto teller machines, bill acceptors are intensively used in MRT (Metropolitan Rapid Transit) stations, railway stations, bus stations, shops, restaurants, schools, hospitals and many other public places. These machines save much labor cost, and bring convenience to consumers. Further, advanced automatic vending machines vend drinks, cigarettes, tickets, ice creams, memorial coins, key rings, or even hamburgers and noodles. Nowadays, Q-shops are seen in many places to provide different services to consumers. A Q-shop has the advantages of scientific intelligence, quick service, and quick finish of payment. Further, many virtual shops are established to provide online shopping services, allowing shoppers to shop across millions of products.

Further, an automatic vending machine, card dispenser, ticket vending machine or coin exchanging machine commonly uses a bill acceptor to check the authenticity and value of each inserted bill and a bill box to collect each received bill. FIG. 11 illustrates a prior art bill box design. According to this prior art design, the bill box A has an anti-theft device A12 and a baffle plate B arranged around the top opening All of the bill entrance A1 thereof, a bill-receiving bearing board A2 mounted on the inside and supported on spring members A3 for receiving each bill transferred through the bill entrance A1 into the inside of the bill box A. This prior art design of bill box is not satisfactory in function and has drawbacks as follows:

1. When a bill is sent into the bill entrance A1 of the bill box A, it will be immediately transferred to the bill-receiving bearing board A2. However, when a next bill is being transferred to the bill-receiving bearing board A2, it may force the lastly received bill to fall from the bill-receiving bearing board A2 to the bottom side inside the bill box A or to jam in between the bill-receiving bearing board A2 and the shell of the bill box A, causing moving instability of the bill-receiving bearing board A2.
2. Bills stacked on the bill-receiving bearing board A2 may be wrinkled, affecting further bill receiving operation and reducing the bill receiving capacity of the bill box.
3. When the bill box A is used to collect different sizes of bills, bills of a relatively smaller size may slip in bills of a relatively larger size, and collected bills will not be neatly stacked on the bill-receiving bearing board A2, interfering with a further bill receiving operation.

Because bill acceptors are commonly used in automatic vending machines, card dispensers, ticket vending machines and coin exchanging machines and equipped with a bill box for collecting bills, the design of the bill box may affect the functioning of the bill acceptor. Accordingly, there is a need for a bill box for bill acceptor that eliminates the aforesaid problem.

SUMMARY OF THE INVENTION

The present invention has been accomplished under the circumstances in view. It is therefore the main object of the present invention to provide a bill box for bill acceptor, which eliminates the drawbacks of the prior art designs.

To achieve this and other objects of the present invention, a bill acceptor assembly comprises a bill acceptor and a bill box mounted in the bill acceptor. The bill box comprises a box body and an anti-skid device. The box body comprises an accommodation chamber, a bill entrance for guiding a bill from the bill acceptor into the accommodation chamber, a bill-receiving bearing board suspended inside the accommodation chamber, a bill-pressing board disposed inside the accommodation chamber and a bill transfer mechanism adapted for moving the bill-pressing board to push a bill out of the bill entrance onto the bill-receiving bearing board. The anti-skid device comprises two baffles arranged in parallel at two opposite lateral sides inside the box body between the bill-pressing board and the bill-receiving bearing board, and an anti-skid pad covered on the back wall of each the baffle for stopping each received bill on the bill-receiving bearing board to keep each received bill in a fully extended smooth condition without wrinkle.

Further, the bill acceptor comprises a machine body having a bill inlet and a bill passage inwardly extended from the bill inlet, a sensor system mounted in the machine body and adapted for sensing the presence of a bill in the bill passage and verifying the authenticity of the bill, and an anti-theft unit set in a rear side of the bill passage and adapted to prohibit withdrawal of each received bill by a tool by an evil person.

Further, each anti-skid pad of the anti-skid device of the bill box can be formed integral with the back wall of the associating baffle. Alternatively, each anti-skid pad can be separately made and then affixed to the back wall of the associating baffle with an adhesive. Further, each anti-skid pad can cover the whole surface area, or a part of the back wall of the associating baffle subject to the size of bills to be received or the smallest size of bills to be received.

Further, each anti-skid pad of the anti-skid device of the bill box has a coarse surface consisting of folds and furrows, and/or narrow elongated toothed portions, and/or raised portions, and/or recessed portions.

DETAILED DESCRIPTION OF THE PREFERRED EMBODIMENT

Figure 1:
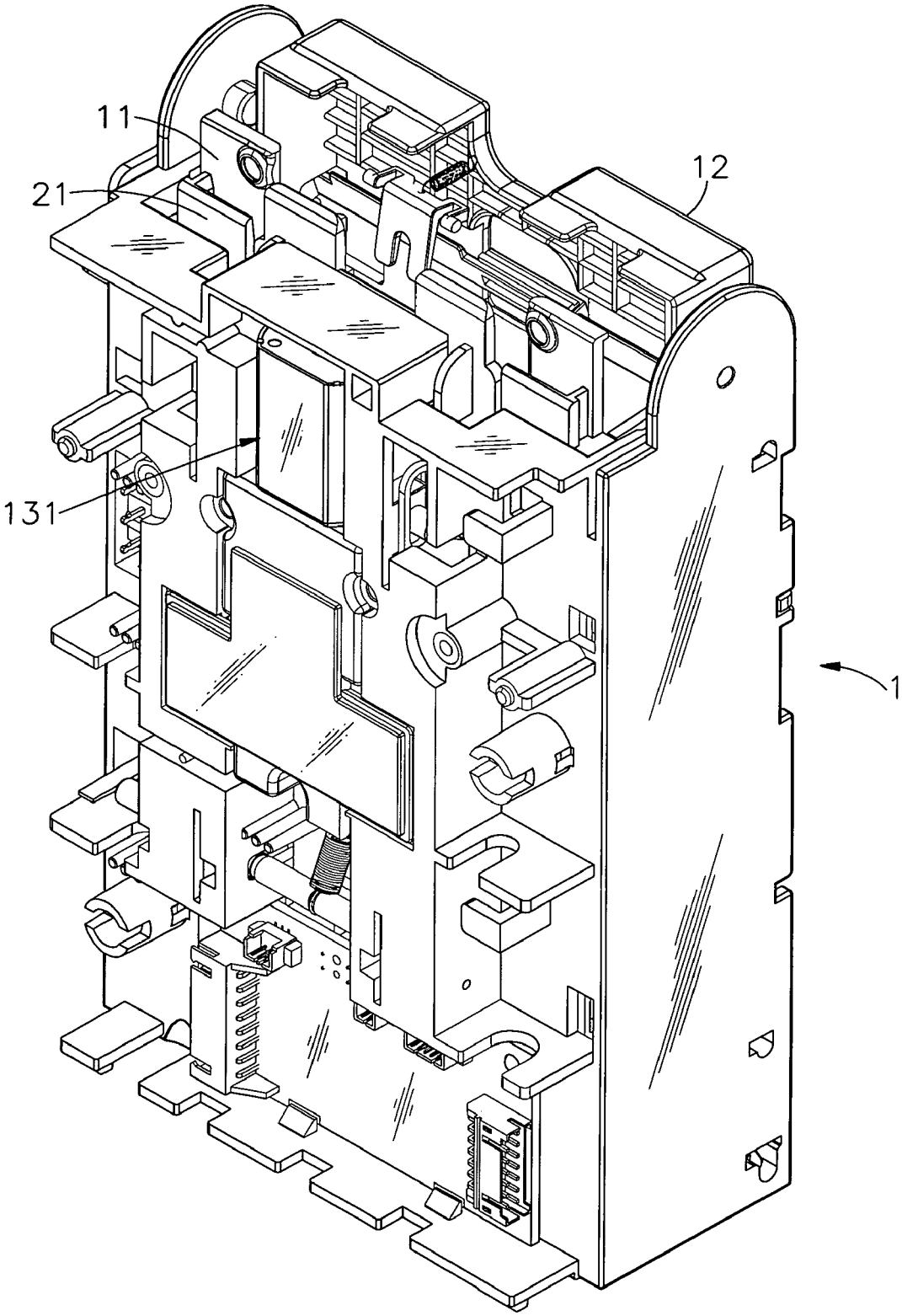
FIG. 1 is an oblique elevation of a bill box according to the present invention.
Figure 2:
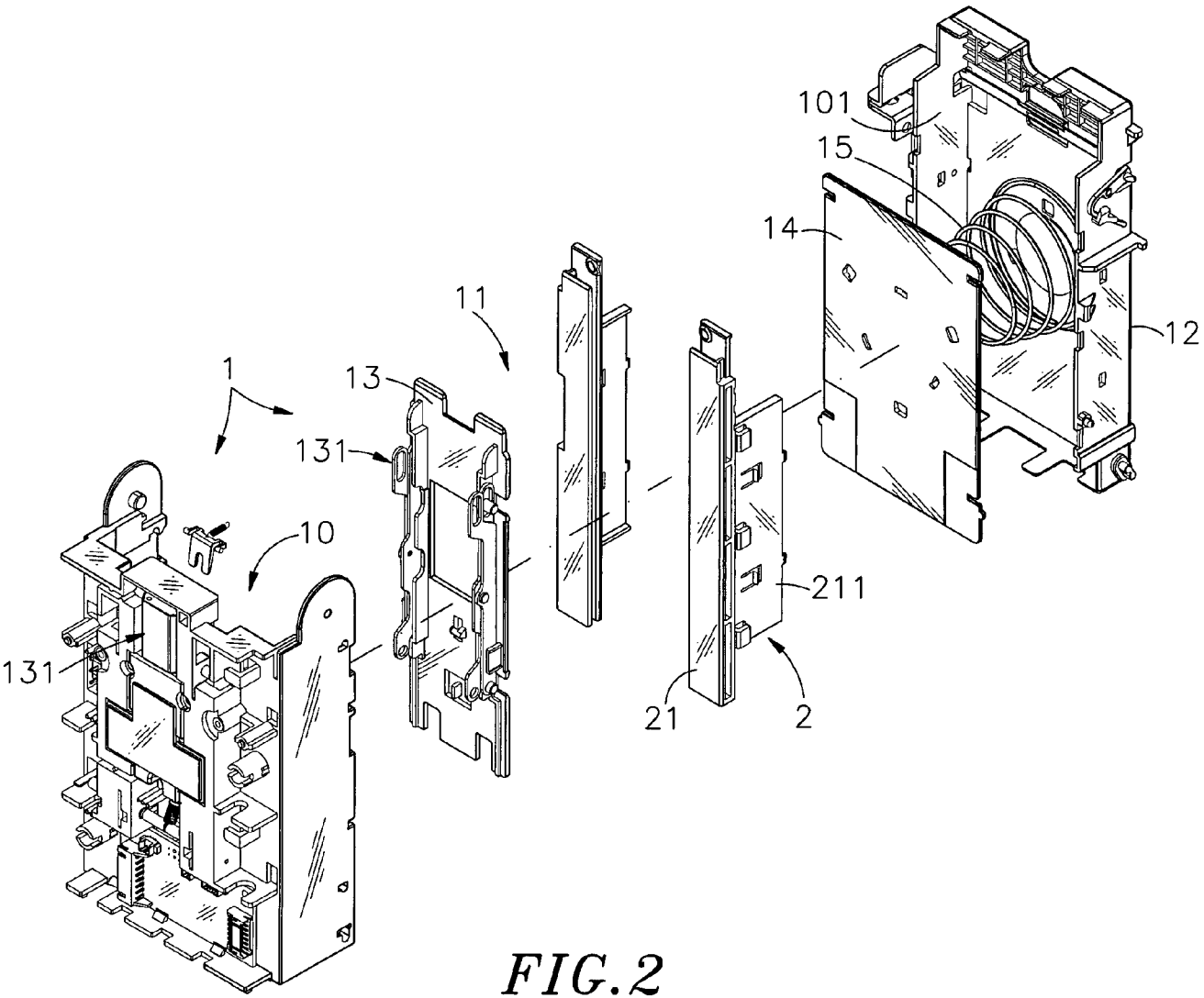
FIG. 2 is an exploded view of the bill box in a reduced scale according to the present invention.
Figure 3:
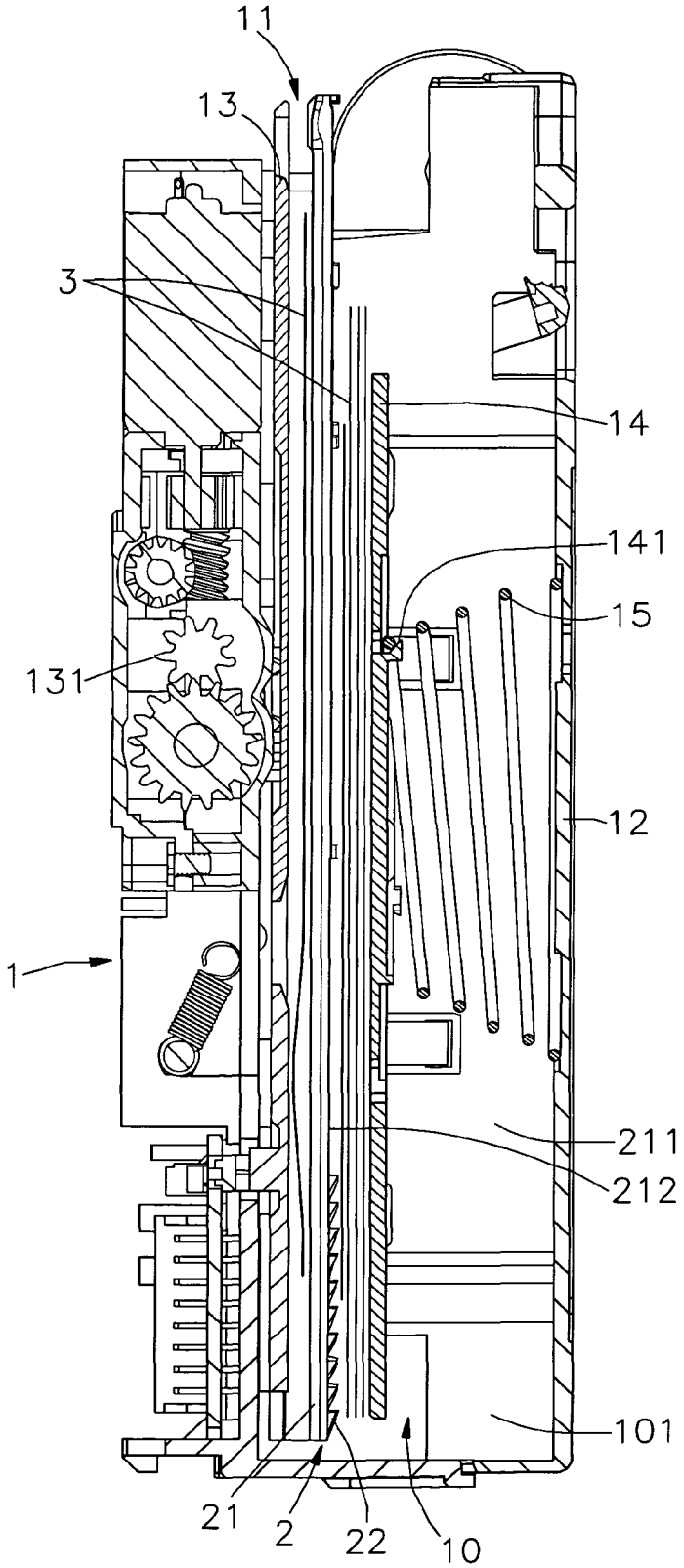
FIG. 3 is a sectional side view of the bill box according to the present invention.
Figure 4:
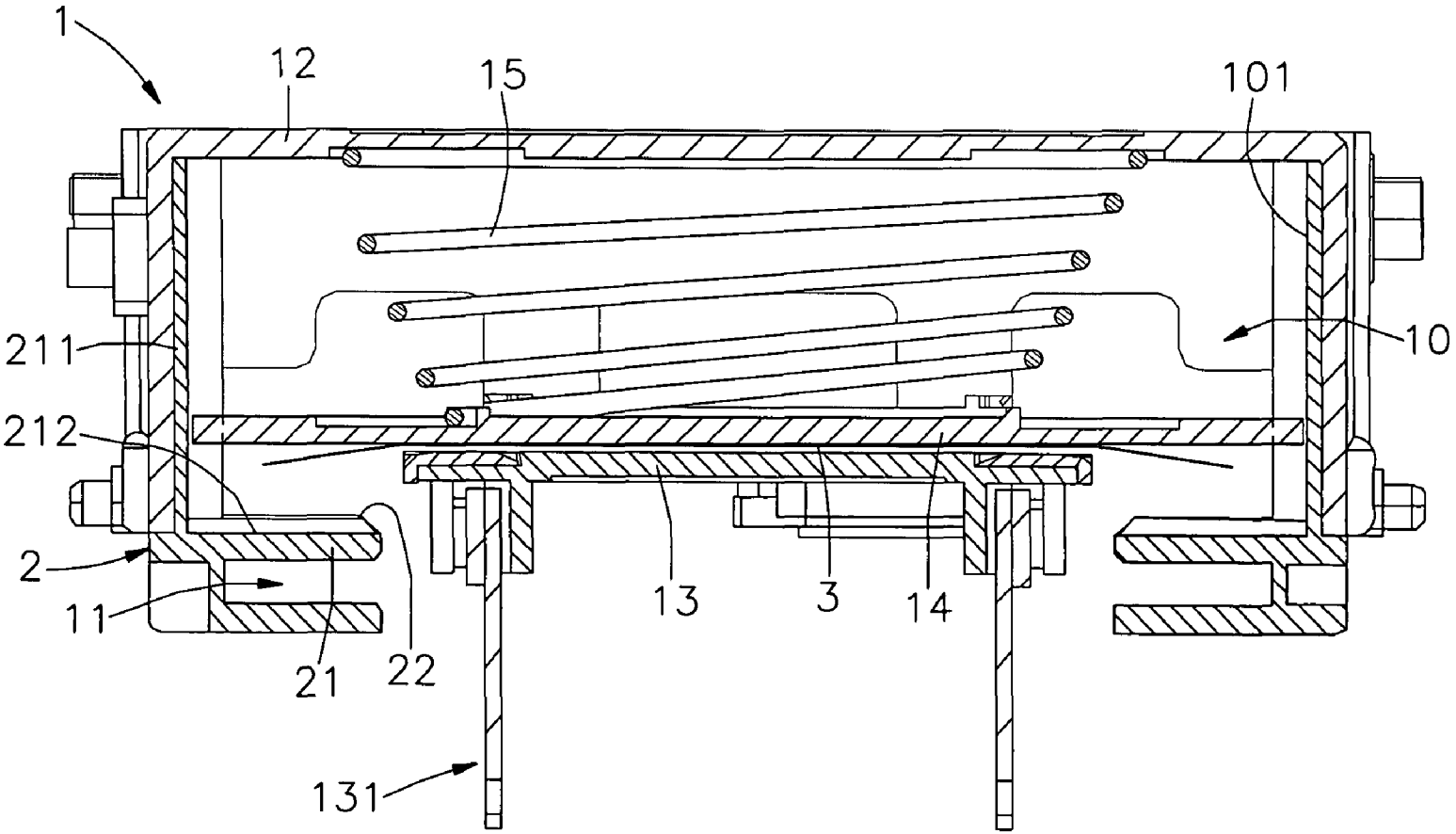
FIG. 4 is a schematic sectional view of a part of the bill box, showing the bill-pressing board pressed a bill on the bill-receiving bearing board.
Figure 5:
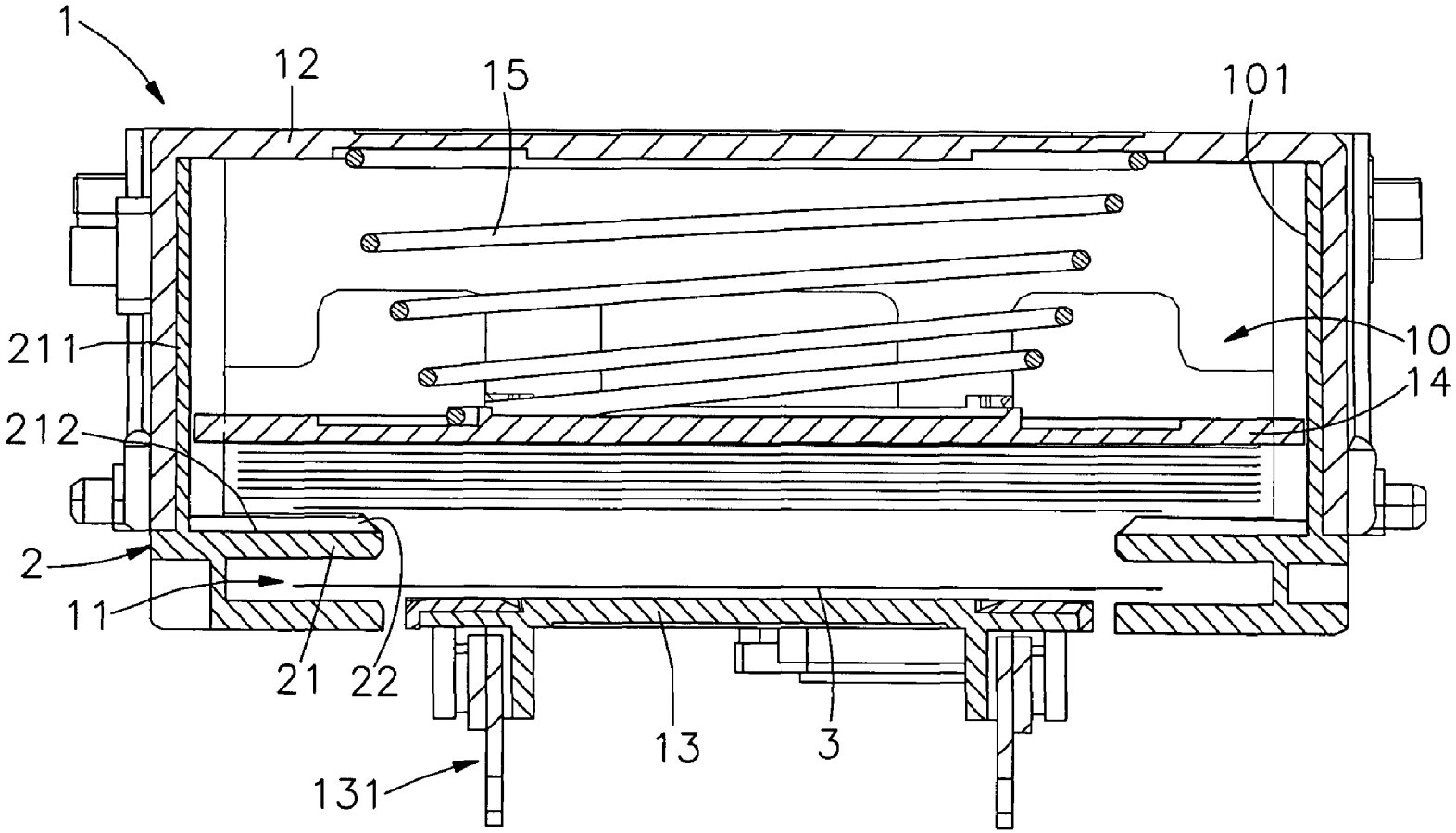
FIG. 5 corresponds to FIG. 4, showing the bill-pressing board returned, collected bills held between the bill-receiving bearing board and the anti-skid pads of the baffles of the anti-skid device.
Figure 6:
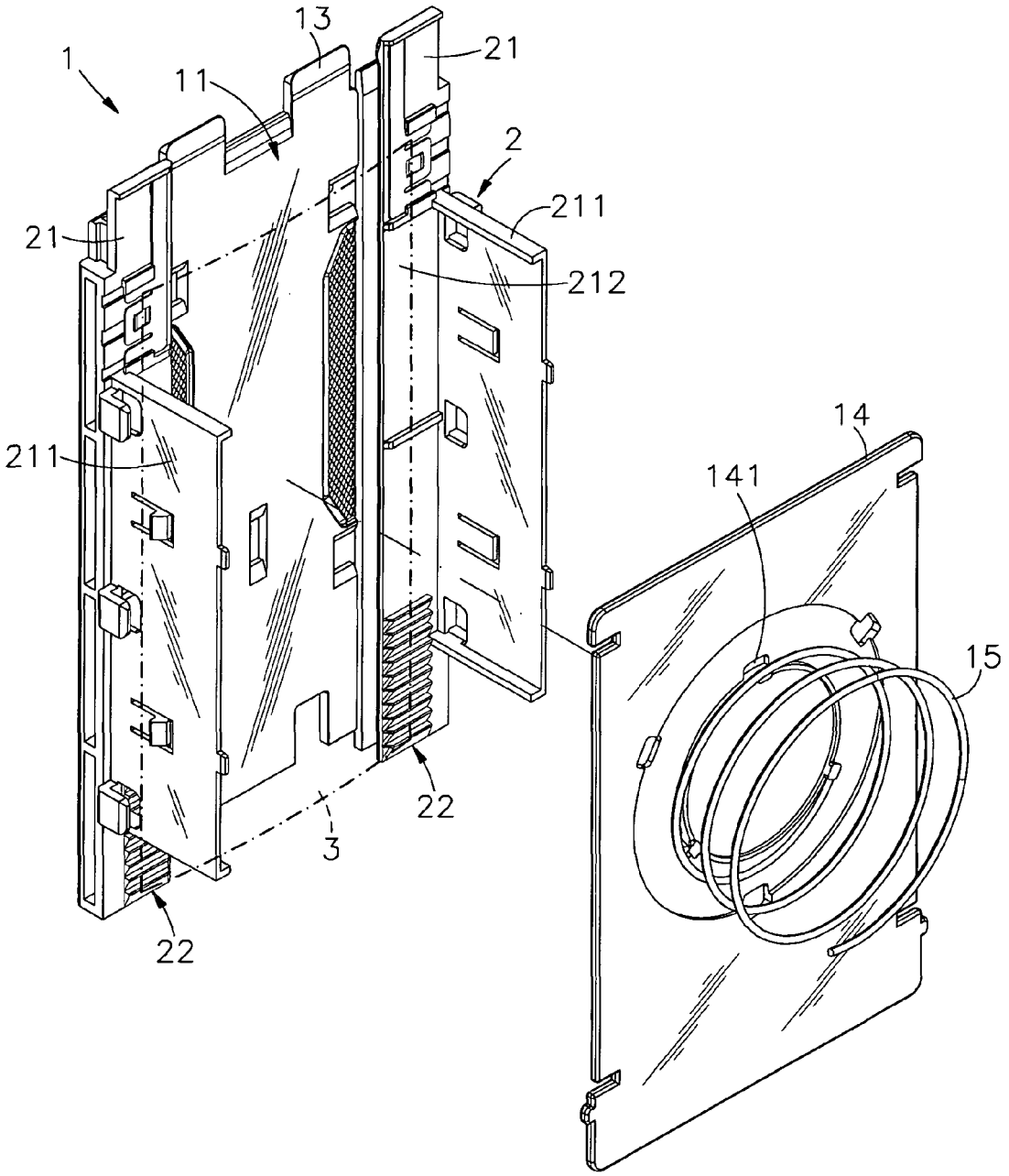
FIG. 6 is another exploded view of the bill box according to the present invention.

Referring to FIGS. 1~4, a bill box is shown comprising a box body 1 and an anti-skid device 2.

The box body 1 comprises a box body shell 12, which defines an inside accommodation chamber 10 and a bill entrance 11, a bill-receiving bearing board 14 suspended inside the accommodation chamber 10 and movable forwards and backwards relative to the bill entrance 11, an elastic support member 15 mounted on the inside wall of the box body shell 12 and connected to a connection 141 at the back side of the bill-receiving bearing board 14 to impart a pressure to the bill-receiving bearing board 14 toward the bill entrance 11 and a bill-pressing board 13 suspended inside the accommodation chamber 10 at one side of the bill entrance 11 opposite to the bill-receiving bearing board 14 and movable by a bill transfer mechanism 131 across the bill entrance 11 toward the bill-receiving bearing board 14 to press a bill 3 out of the bill entrance 11 onto the bill-receiving bearing board 14.

The anti-skid device 2 comprises two elongated baffles 21. Each baffle 21 has a positioning wing plate 211 perpendicularly extended from the outer lateral side thereof, and an anti-skid pad 22 covered on the back wall 212 thereof.

During installation, the two baffles 21 are positioned inside the accommodation chamber 10 at two opposite lateral sides with the respective positioning wing plates 211 respectively affixed to two opposite sidewalls 101 of the accommodation chamber 10 such that the bill-pressing board 13 can be moved by the bill transfer mechanism 131 through the bill entrance 11 and the gap between the two baffles 21 toward the bill-receiving bearing board 14 to press a bill 3 out of the bill entrance 11 onto the bill-receiving bearing board 14. After installation, the anti-skid pads 22 of the baffles 21 face the bill-receiving bearing board 14.

Figure 7:
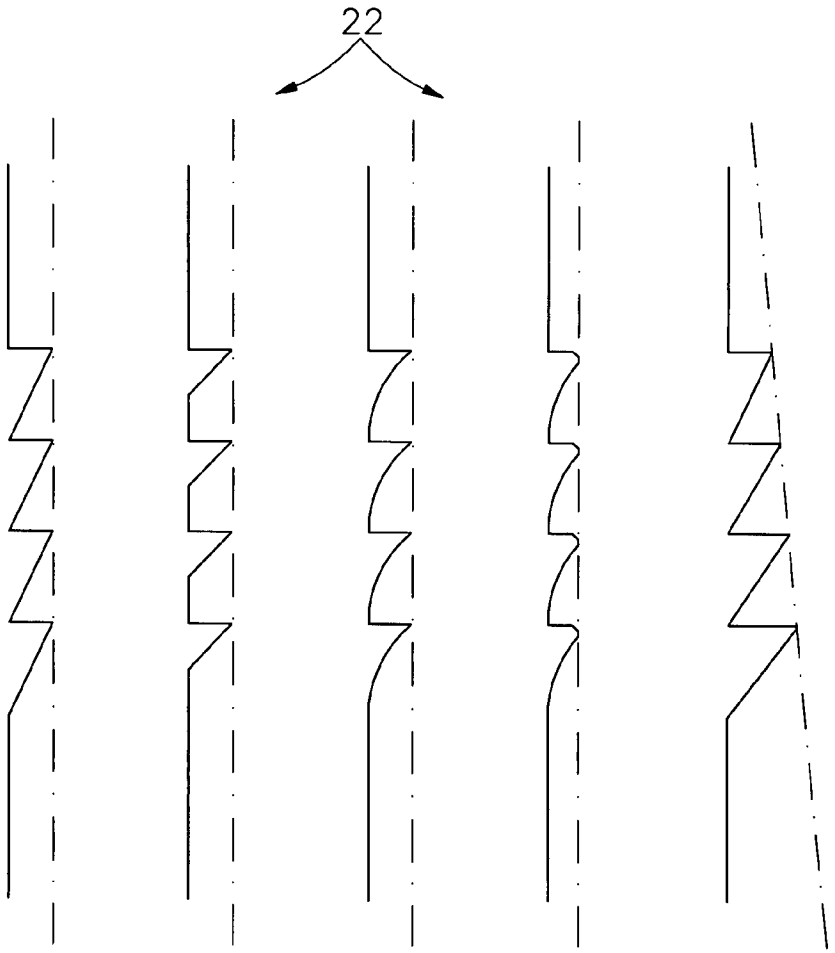
FIG. 7 is a schematic drawing showing different surface designs of anti-skid pads according to the present invention.
Figure 8:
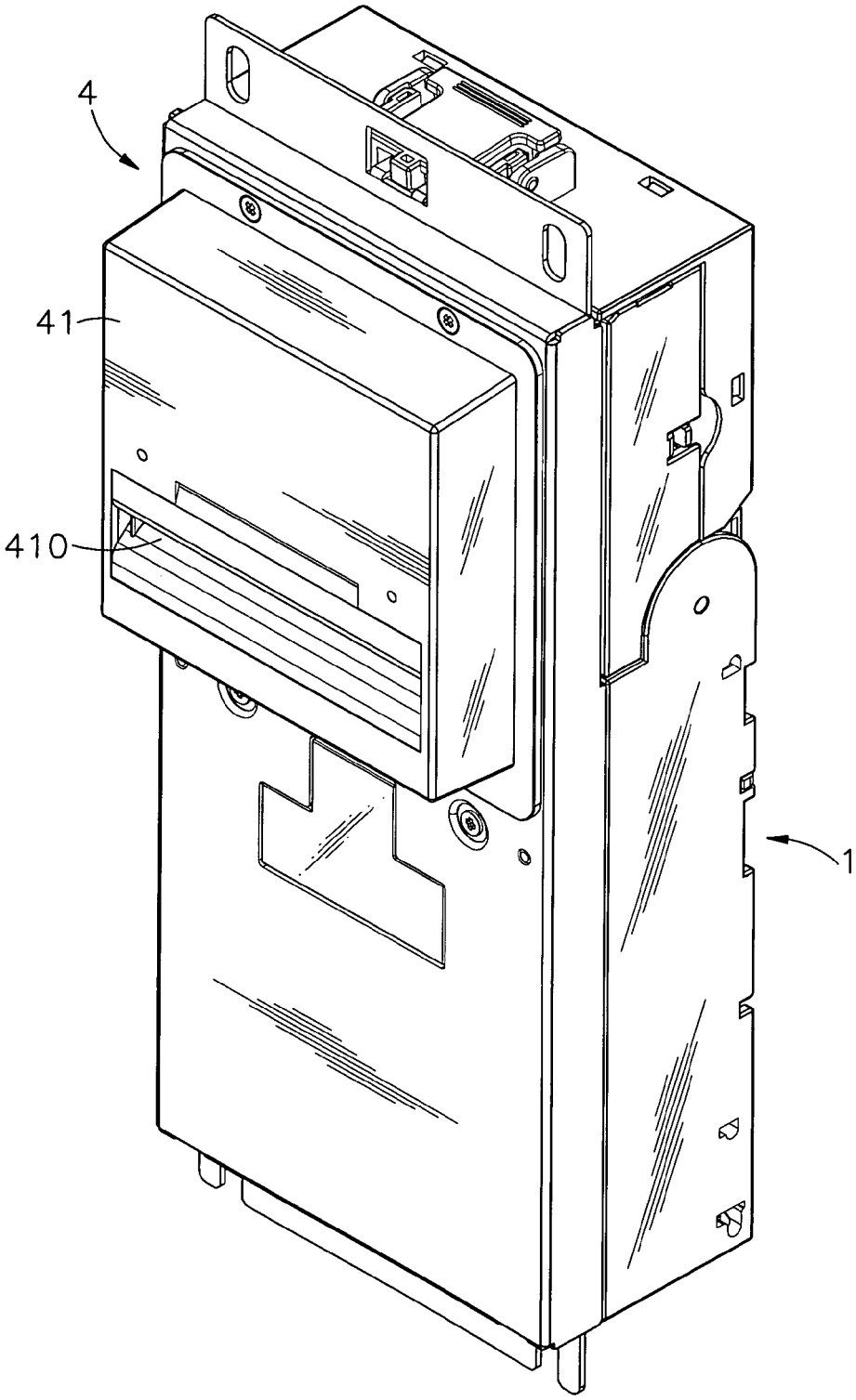
FIG. 8 is an oblique elevation of a bill acceptor assembly according to the present invention.
Figure 9:
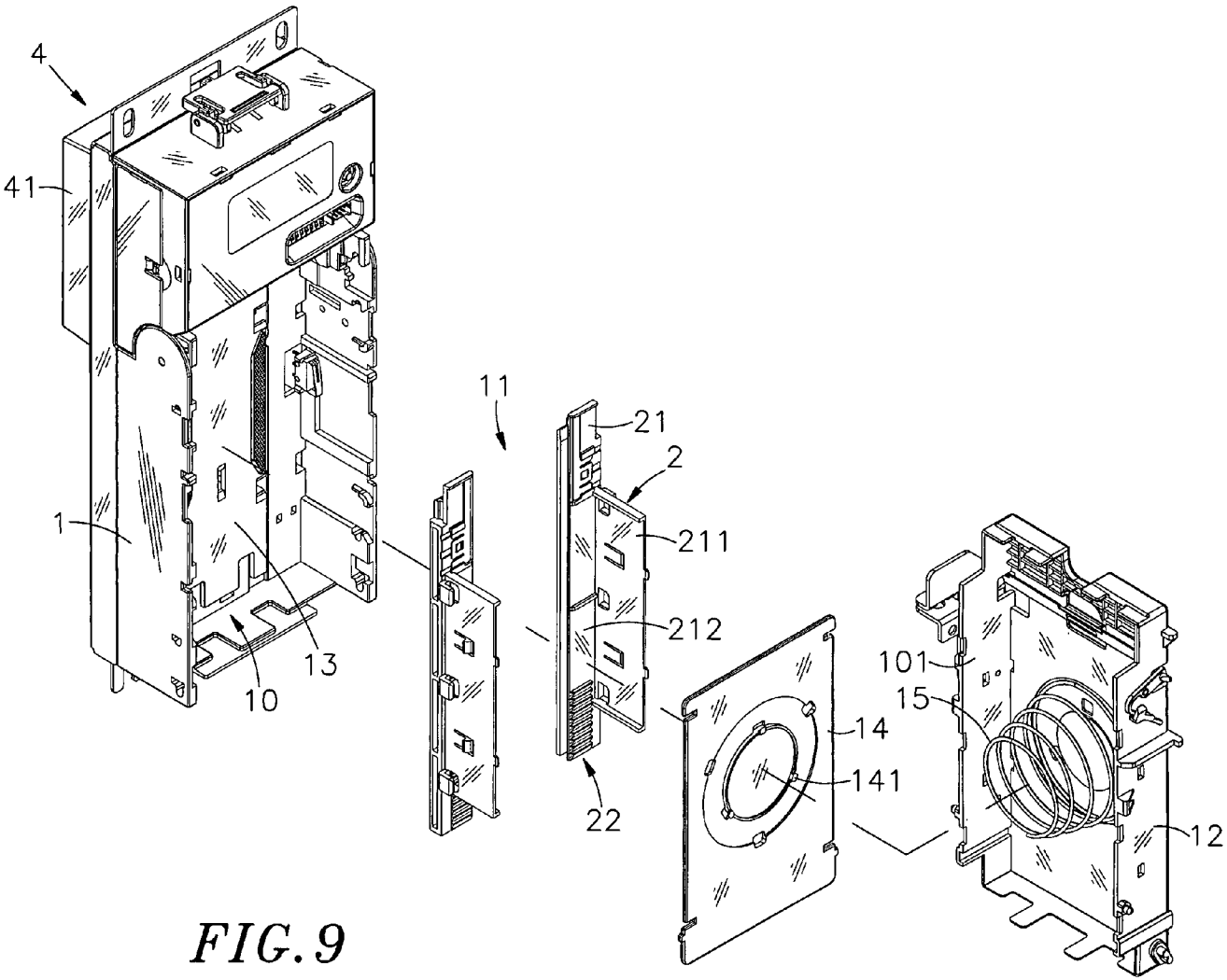
FIG. 9 is an exploded view, in a reduced scale, of the bill acceptor assembly according to the present invention.
Figure 10:
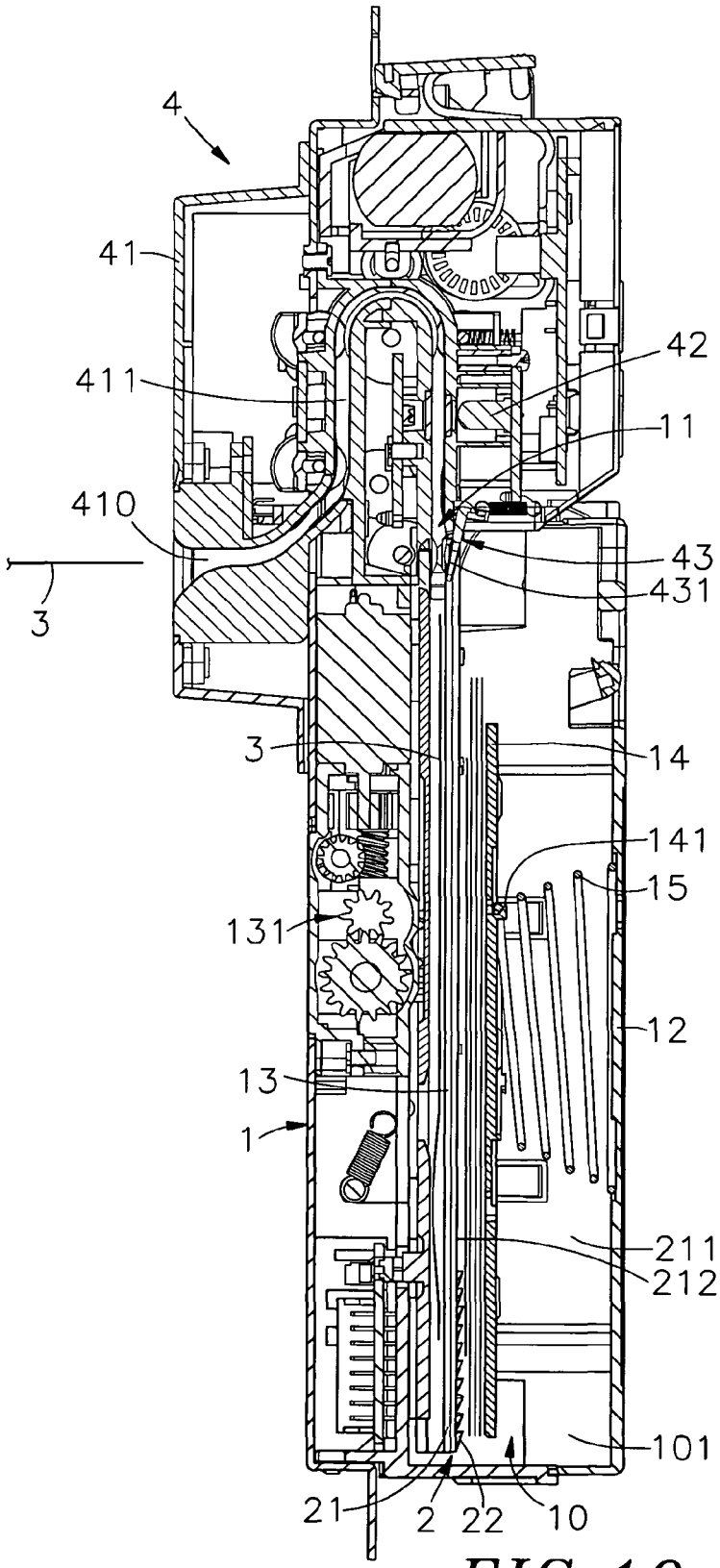
FIG. 10 is a sectional side view, in an enlarged scale, of the bill acceptor assembly according to the present invention.
Figure 11:
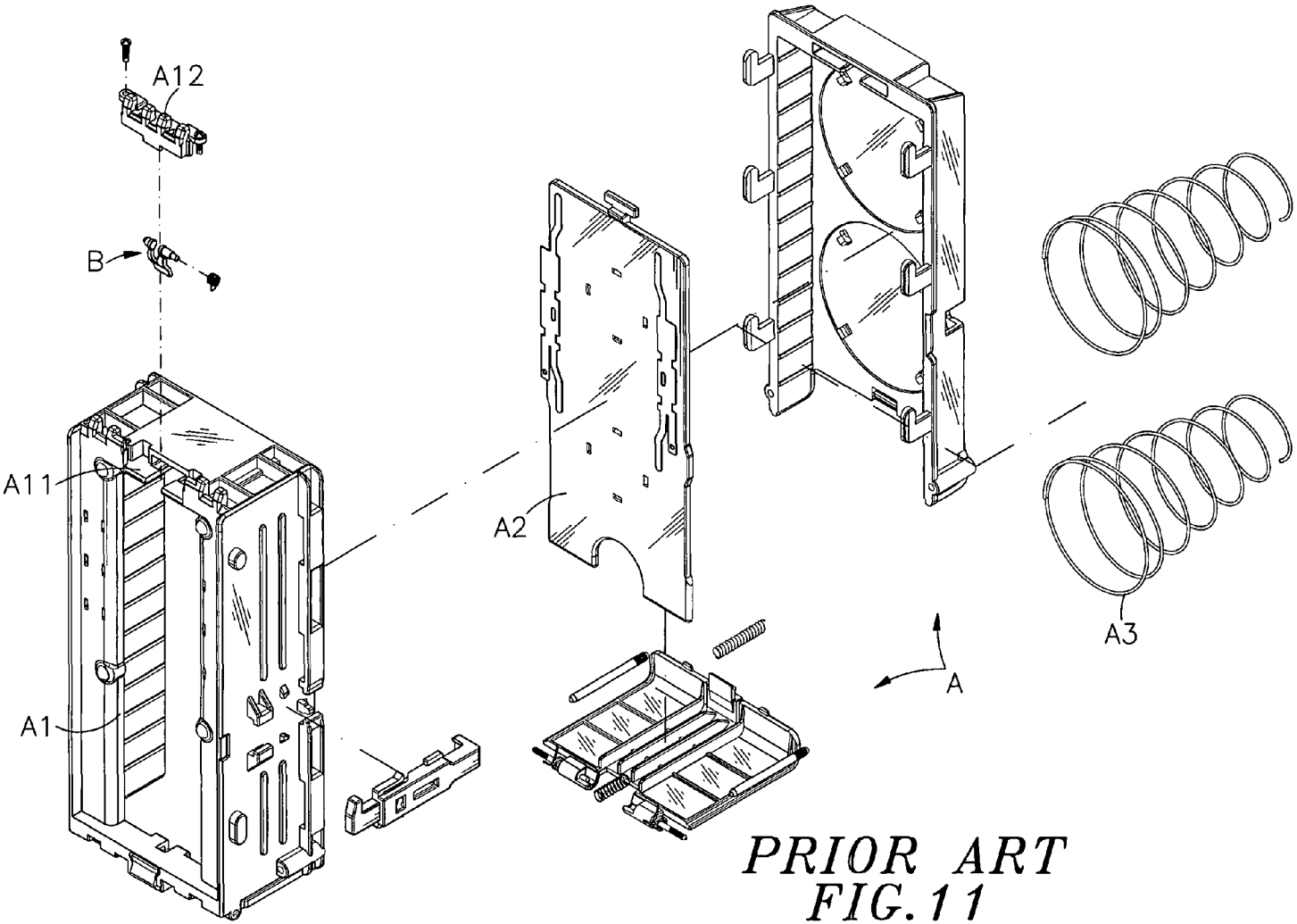
PRIOR ART FIG. 11
FIG. 11 is an exploded view of a bill box according to the prior art.

Further, the elastic support member 15 that is set between the inside wall of the box body shell 12 and the bill-receiving bearing board 14 can be a spiral spring, helical spring, plate spring or elastic pad. Further, the anti-skid pad 22 that is covered on the back wall 212 of each elongated baffle 21 of the anti-skid device 2 has a coarse surface. The anti-skid pad 22 can be molded from rubber, plastics or any material with high friction coefficient. The coarse surface of the anti-skid pad 22 can be formed, having folds and furrows, narrow elongated toothed portions, raised portions and/or recessed portions (see FIG. 7). The anti-skid pad 22 may be directly molded on the back wall 212 of each elongated baffle 21 of the anti-skid device 2. Alternatively, the anti-skid pad 22 can be separately made and then adhered to the back wall 212 of each elongated baffle 21 of the anti-skid device 2.

Referring to FIGS. 2, 4, 5, 6 and 10, when one bill 3 is transferred through the bill entrance 11 of the box body 1 into the inside of the accommodation chamber 10 in between the bill-pressing board 13 and the two baffles 21, the bill transfer mechanism 131 is operated to move the bill-pressing board 13 through the gap between the two baffles 21 toward the bill-receiving bearing board 14 so that the bill-pressing board 13 will push the bill 3 away from the bill entrance 11 and press the bill 3 onto the bill-receiving bearing board 14. After the bill 3 has been moved by the bill-pressing board 13 over the baffles 21 and pressed onto the bill-receiving bearing board 14, the bill-pressing board 13 is returned to its former position by the bill transfer mechanism 131. At this time, the bill-receiving bearing board 14 is forced forwards toward the baffles 21 by the elastic support member 15, causing the received bill 3 to be stopped between the bill-receiving bearing board 14 and the anti-skid pads 22 of the baffles 21. Thus, the received bill 3 is held on the bill-receiving bearing board 14 positively by the anti-skid pads 22 and kept in a smooth condition without wrinkles, and therefore the received bill 3 will not fall to the bottom side in the accommodation chamber 10. Thus, bills 3 can be accurately transferred through the bill entrance 11 into the inside of the accommodation chamber 10 and accurately pressed onto the bill-receiving bearing board 14 by the bill-pressing board 13 and positively and smoothly retained in a stack between the two baffles 21 and the bill-receiving bearing board 14. Based on the aforesaid arrangement, the depth in which the bill entrance 11 extends to the inside of the accommodation chamber 10 can be shortened, and therefore the length of rails for the bill entrance 11 and the size or length of the related bill-transfer rollers and bill-transfer belt can be minimized, i.e., the bill-transfer distance in the accommodation chamber 10 is relatively shortened. Further, by means of the elastic force of the elastic support member 15, the distance between the bill-receiving bearing board 14 and the anti-skid pads 22 of the baffles 21 is automatically adjusted subject to the thickness of the bills 3 collected at the bill-receiving bearing board 14 so that the bills 3 collected at the bill-receiving bearing board 14 are positively held between the anti-skid pads 22 of the baffles 21 and the bill-receiving bearing board 14.

Further, the anti-skid pad 22 on each baffle 21 can cover the whole surface area of the back wall 212 of the associating baffle 21. Alternatively, the anti-skid pad 22 on each baffle 21 can cover only a part of the back wall 212 of the associating baffle 21 subject to the smallest size of bills 3 to be collected. When one bill 3 is transferred into the accommodation chamber 10 and attached to the bill-receiving bearing board 14, the anti-skid pads 22 of the baffles 21 holds down the duly collected bill 3 on the bill-receiving bearing board 14 in a fully extended smooth condition without wrinkles, avoiding bill jam in a next bill-receiving operation.

Referring to FIGS. 2, 3, 8, 9 and 10, the aforesaid bill box is installed in a bill acceptor 4. The bill acceptor 4 comprises a machine body 41 equipped with an electric equipment (not shown). The machine body 41 comprises a bill inlet 410, a bill passage 411 inwardly extended from the bill inlet 410 to the bill entrance 11 of the box boy 1, a sensor system 42 having bill sensor means and bill recognition means (not shown) installed in the bill passage 411 at suitable locations and adapted for sensing the presence of a bill 3 in the bill passage 411 and verifying the authenticity of the bill 3 and an anti-theft unit 43 set in between the bill passage 411 and the bill entrance 11. The anti-theft unit 43 includes an anti-theft baffle plate 431 to prohibit withdrawal of the received bill 3 by a tool by an evil person. The box body 1 of the bill box is mounted in the machine body 41 of the bill acceptor 4 to keep the bill entrance 11 in communication with the bill passage 411 so that the bill transfer mechanism 131 can be controlled by the bill acceptor 4 to transfer each recognized bill 3 from the bill passage 411 through the bill entrance 11 into the accommodation chamber 10 for enabling the bill 3 to be pushed out of the bill entrance 11 onto the bill-receiving bearing board 14 by the bill-pressing board 13 and then held in between the bill-receiving bearing board 14 and the anti-skid pads 22 of the baffles 21.

Further, as stated above, the anti-skid pad 22 on each baffle 21 can cover the whole surface area of the back wall 212 of the associating baffle 21 or only a part of the back wall 212 of the associating baffle 21 subject to the smallest size of bills 3 to be collected. When one bill 3 is collected, it is held between the anti-skid pads 22 of the baffles 21 and the bill-receiving bearing board 14 in a fully extended smooth condition without wrinkles, avoiding bill jam in a next bill-receiving operation.

Further, as stated above, the anti-skid pad 22 may be directly molded on the back wall 212 of each elongated baffle 21 of the anti-skid device 2, or separately made and then fixedly fastened to the back wall 212 of each elongated baffle 21 of the anti-skid device 2 with an adhesive or by means of a mounting or fixation technique so that the anti-skid pads 22 of the baffles 21 of the anti-skid device 2 can positively hold down one bill 3 or a stack of bills 3 on the bill-receiving bearing board 14 in a fully extended smooth condition without wrinkles.

Further, the machine body 41 of the bill acceptor 4 can be a vertical design or horizontal design. However, the box boy 1 of the bill box must fit the design of the machine body 41 of the bill acceptor 4.

As stated above, the invention provides a bill acceptor and bill box assembly, which comprises a bill acceptor 4 for receiving bills 3 and verifying the authenticity of received bills 3 and a bill box consisting of a box body 1 and an anti-skid device 2 and mounted in the bill acceptor 4 for collecting each received bill 3 from the bill acceptor 4, wherein the box body 1 comprises a box body shell 12 defining an inside accommodation chamber 10 and a bill entrance 11 in communication between the accommodation chamber 10 and the bill passage 411, a bill-receiving bearing board supported on an elastic support member 15 in the accommodation chamber 10, a bill transfer mechanism 131, a bill-pressing board 13 suspended inside the accommodation chamber 10 at one side of the bill entrance 11 opposite to the bill-receiving bearing board 14 and movable by the bill transfer mechanism 131 for pushing a bill 3 out of the bill entrance 11 onto the bill-receiving bearing board 14; the anti-skid device 2 comprises two elongated baffles 21 arranged in parallel in the accommodation chamber 10 at two sides relative to the moving path of the bill-pressing board 13 and an anti-skid pad 22 covered on the back wall 212 of each baffle 21 for holding down each collected bill 3 on the bill-receiving bearing board 14 positively in a fully extended smooth condition without wrinkles.

In conclusion, the invention provides a bill acceptor and bill box assembly, which has the advantages and features as follows:

1. The anti-skid device 2 is mounted in the accommodation chamber 10 between the bill-pressing board 13 and the bill-receiving bearing board 14. When one bill 3 is transferred into the accommodation chamber 10 and pushed out of the bill entrance 11 onto the bill-receiving bearing board 14 by the bill-pressing board 13, the collected bill 3 is held on the bill-receiving bearing board 14 by the anti-skid pads 22 of the baffles 21 of the anti-skid device 2 after return of the bill-pressing board 13 to its former position, and therefore the received bill 3 will not fall to the bottom side in the accommodation chamber 10.
2. When one bill 3 is received and held on the bill-receiving bearing board 14 by the anti-skid pads 22 of the baffles 21 of the anti-skid device 2, the received bill 3 is kept in a fully extended smooth condition without wrinkles, minimizing space occupation in the moving path of the bill-pressing board 13 in the accommodation chamber 10.
3. By means of the anti-skid pads 22 of the baffles 21 of the anti-skid device 2, the bill box is practical for use to collect bills 3 of any of a variety of sizes issued in any country, enabling every collected bill 3 to be positively held between the anti-skid pads 22 of the baffles 21 and the bill-receiving bearing board 14 in a fully extended smooth condition without wrinkles.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bill box connectable to a bill acceptor adapted for receiving each bill recognized by said bill acceptor, comprising:

a box body, said box body comprising an accommodation chamber, a bill entrance for guiding a bill from said bill acceptor into said accommodation chamber, a bill-receiving bearing board suspended inside said accommodation chamber, a bill-pressing board disposed inside said accommodation chamber and a bill transfer mechanism adapted for moving said bill-pressing board to push a bill out of said bill entrance onto said bill-receiving bearing board; and an anti-skid device mounted in said accommodation chamber inside said box body, said anti-skid device comprising two baffles arranged in parallel at two opposite lateral sides between said bill-pressing board and said bill-receiving bearing board, and an anti-skid pad covered on a back wall of each said baffle for stopping each received bill on said bill-receiving bearing board.

2. The bill acceptor and bill box assembly as claimed in claim 1, wherein said box body comprises a box body shell surrounding said accommodation chamber and elastic support means mounted inside said box body shell to support said bill-receiving bearing board.

3. The bill acceptor and bill box assembly as claimed in claim 2, wherein said elastic support means is selected from a material group consisting of spiral springs, helical springs, plate springs and elastic pads.

4. The bill acceptor and bill box assembly as claimed in claim 1, wherein each said anti-skid pad is formed integral with the back wall of the associating baffle.

5. The bill acceptor and bill box assembly as claimed in claim 1, wherein each said anti-skid pad is affixed to the back wall of the associating baffle with adhesive means.

6. The bill acceptor and bill box assembly as claimed in claim 4, wherein each said anti-skid pad covers a part of the back wall of the associating baffle subject to the smallest size of bills to be received.

7. The bill acceptor and bill box assembly as claimed in claim 5, wherein each said anti-skid pad covers a part of the back wall of the associating baffle subject to the smallest size of bills to be received.

8. The bill acceptor and bill box assembly as claimed in claim 1, wherein each said anti-skid pad has a coarse surface consisting of folds and furrows, and/or narrow elongated toothed portions, and/or raised portions, and/or recessed portions.

9. A bill acceptor assembly, comprising a bill acceptor adapted for receiving a bill and recognizing the authenticity of the bill and a bill box fastened to said bill acceptor and adapted for collecting each bill recognized by said bill acceptor, wherein said bill box comprises:

a box body, said box body comprising an accommodation chamber, a bill entrance for guiding a bill from said bill acceptor into said accommodation chamber, a bill-receiving bearing board suspended inside said accommodation chamber, a bill-pressing board disposed inside said accommodation chamber and a bill transfer mechanism adapted for moving said bill-pressing board to push a bill out of said bill entrance onto said bill-receiving bearing board; and an anti-skid device mounted in said accommodation chamber inside said box body, said anti-skid device comprising two baffles arranged in parallel at two opposite lateral sides between said bill-pressing board and said bill-receiving bearing board, and an anti-skid pad covered on a back wall of each said baffle for stopping each received bill on said bill-receiving bearing board.

10. The bill acceptor and bill box assembly as claimed in claim 8, wherein said box body comprises a box body shell surrounding said accommodation chamber and elastic support means mounted inside said box body shell to support said bill-receiving bearing board.

11. The bill acceptor and bill box assembly as claimed in claim 9, wherein said elastic support means is selected from a material group consisting of spiral springs, helical springs, plate springs and elastic pads.

12. The bill acceptor and bill box assembly as claimed in claim 8, wherein each said anti-skid pad is formed integral with the back wall of the associating baffle.

13. The bill acceptor and bill box assembly as claimed in claim 8, wherein each said anti-skid pad is affixed to the back wall of the associating baffle with adhesive means.

14. The bill acceptor and bill box assembly as claimed in claim 12, wherein each said anti-skid pad covers a part of the back wall of the associating baffle subject to the smallest size of bills to be received.

15. The bill acceptor and bill box assembly as claimed in claim 13, wherein each said anti-skid pad covers a part of the back wall of the associating baffle subject to the smallest size of bills to be received.

16. The bill acceptor and bill box assembly as claimed in claim 9, wherein each said anti-skid pad has a coarse surface consisting of folds and furrows, and/or narrow elongated toothed portions, and/or raised portions, and/or recessed portions.

17. A bill acceptor assembly, comprising:

a bill acceptor, said bill acceptor comprising a machine body, said machine body comprising a bill inlet, a bill passage inwardly extended from said bill inlet, a sensor system, said sensor system comprising bill sensor means and bill recognition means installed in said bill passage at selected locations and adapted for sensing the presence of a bill in said bill passage and verifying the authenticity of the bill, and an anti-theft unit set in a rear side of said bill passage and adapted to prohibit withdrawal of each received bill by a tool by an evil person; and a bill box, said bill box comprising a box body mounted in said machine body of said bill acceptor, said box body comprising an accommodation chamber, a bill entrance connected to the rear side of said bill passage of said bill acceptor and adapted for guiding a bill from said bill passage of said bill acceptor into said accommodation chamber, a bill-receiving bearing board suspended inside said accommodation chamber, a bill-pressing board disposed inside said accommodation chamber and a bill transfer mechanism adapted for moving said bill-pressing board to push a bill out of said bill entrance onto said bill-receiving bearing board, and an anti-skid device mounted in said accommodation chamber inside said box body, said anti-skid device comprising two baffles arranged in parallel at two opposite lateral sides between said bill-pressing board and said bill-receiving bearing board, and an anti-skid pad covered on a back wall of each said baffle for stopping each received bill on said bill-receiving bearing board.

18. The bill acceptor and bill box assembly as claimed in claim 15, wherein said machine body of said bill acceptor is a horizontal design; said bill box is a horizontal design fitting the horizontal design of said machine body.

19. The bill acceptor and bill box assembly as claimed in claim 15, wherein said machine body of said bill acceptor is a vertical design; said bill box is a vertical design fitting the vertical design of said machine body.

20. The bill acceptor and bill box assembly as claimed in claim 15, wherein said box body of said bill box comprises a box body shell surrounding said accommodation chamber and elastic support means mounted inside said box body shell to support said bill-receiving bearing board.

21. The bill acceptor and bill box assembly as claimed in claim 18, wherein said elastic support means is selected from a material group consisting of spiral springs, helical springs, plate springs and elastic pads.

22. The bill acceptor and bill box assembly as claimed in claim 15, wherein each said anti-skid pad is formed integral with the back wall of the associating baffle.

23. The bill acceptor and bill box assembly as claimed in claim 15, wherein each said anti-skid pad is affixed to the back wall of the associating baffle with adhesive means.

24. The bill acceptor and bill box assembly as claimed in claim 22, wherein each said anti-skid pad covers a part of the back wall of the associating baffle subject to the smallest size of bills to be received.

25. The bill acceptor and bill box assembly as claimed in claim 23, wherein each said anti-skid pad covers a part of the back wall of the associating baffle subject to the smallest size of bills to be received.

26. The bill acceptor and bill box assembly as claimed in claim 17, wherein each said anti-skid pad has a coarse surface consisting of folds and furrows, and/or narrow elongated toothed portions, and/or raised portions, and/or recessed portions.

* * * * *